US010988820B2

(12) United States Patent
Mao et al.

(10) Patent No.: US 10,988,820 B2
(45) **Date of Patent: *Apr. 27, 2021**

(54) 1500 MPA GRADE PRESS HARDENING STEEL BY MEDIUM THIN SLAB CASTING AND DIRECT ROLLING AND METHOD FOR PRODUCING THE SAME

(71) Applicant: WUHAN IRON AND STEEL COMPANY LIMITED, Hubei (CN)

(72) Inventors: Xinping Mao, Hubei (CN); Kuanhui Hu, Hubei (CN); Shuize Wang, Hubei (CN); Libo Pan, Hubei (CN); Rui Ge, Hubei (CN); Lijun Li, Hubei (CN); Tao Peng, Hubei (CN); Xiaofeng Du, Hubei (CN); Fang Fang, Hubei (CN)

(73) Assignee: WUHAN IRON AND STEEL COMPANY LIMITED, Hubei (CN)

( * ) Notice: Subject to any disclaimer, the term of this patent is extended or adjusted under 35 U.S.C. 154(b) by 162 days.

This patent is subject to a terminal disclaimer.

(21) Appl. No.: 16/322,103

(22) PCT Filed: Aug. 1, 2017

(86) PCT No.: PCT/CN2017/095493

§ 371 (c)(1),
(2) Date: Jan. 30, 2019

(87) PCT Pub. No.: WO2018/036347

PCT Pub. Date: Mar. 1, 2018

(65) Prior Publication Data

US 2019/0177811 A1 Jun. 13, 2019

(30) Foreign Application Priority Data

Aug. 24, 2016 (CN) ..... 201610713635.5

(51) Int. Cl.
*C21D 1/673* (2006.01)
*C21D 8/02* (2006.01)
(Continued)

(52) U.S. Cl.
CPC ..... *C21D 8/0263* (2013.01); *C21D 1/673* (2013.01); *C21D 8/005* (2013.01); *C21D 8/021* (2013.01);
(Continued)

(58) Field of Classification Search
CPC ..... B21B 1/46; B22D 11/001; C21D 1/18; C21D 8/0205; C21D 8/0231; C21D 8/0263; C22C 33/04; C22C 38/18; C22C 38/32
(Continued)

(56) References Cited

U.S. PATENT DOCUMENTS 3,269,007 A * 8/1966 O'Donnell ..... B21D 1/02 72/178
4,531,973 A * 7/1985 Nixon ..... C21B 13/12 75/10.41
(Continued)

FOREIGN PATENT DOCUMENTS

CN 101775545 7/2010
CN 102031456 A * 4/2011
(Continued)

OTHER PUBLICATIONS

NPL: On-line translation of CN104532156A, Apr. 2015 (Year: 2015).*
(Continued)

*Primary Examiner* — Jie Yang
(74) *Attorney, Agent, or Firm* — JCIP Global Inc.

(57) ABSTRACT

A press hardening steel by a medium thin slab and having a tensile strength of 1500 MPa or more, includes following
(Continued)

components by weight percent: C: 0.21%-0.25%, Si: 0.26%-0.30%, Mn: 1.0%-1.3%, P≤0.01%, S≤0.005%, Als: 0.015%-0.060%, Cr: 0.25%-0.30%, Ti: 0.026%-0.030% or Nb: 0.026%-0.030% or V: 0.026%-0.030% or a mixture of any two or more of the above in any proportion, B: 0.003%-0.004%, Mo: 0.17-0.19% and N≤0.005%. A method for producing the press hardening steel includes following steps: molten iron desulphurization; smelting and refining by an electric furnace or converter; continuous casting; descaling treatment before entering a soaking furnace; hating and soaking; high pressure water descaling before entering a rolling mill; hot rolling; cooling; coiling; austenitizing; die deforming and quenching.

2 Claims, 1 Drawing Sheet

(51) Int. Cl.

| | |
|---|---|
| ***C21D 9/00*** | (2006.01) |
| ***C21D 8/04*** | (2006.01) |
| ***C21D 9/48*** | (2006.01) |
| ***C21D 8/00*** | (2006.01) |
| ***C22C 38/12*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/32*** | (2006.01) |
| *C21D 1/18* | (2006.01) |
| *C21D 9/46* | (2006.01) |

(52) U.S. Cl.
CPC ..... *C21D 8/0426* (2013.01); *C21D 8/0463* (2013.01); *C21D 9/0068* (2013.01); *C21D 9/48* (2013.01); *C22C 38/001* (2013.01); *C22C 38/02* (2013.01); *C22C 38/04* (2013.01); *C22C 38/06* (2013.01); *C22C 38/12* (2013.01); *C22C 38/22* (2013.01); *C22C 38/24* (2013.01); *C22C 38/26* (2013.01); *C22C 38/28* (2013.01); *C22C 38/32* (2013.01); *C21D 1/18* (2013.01); *C21D 9/46* (2013.01)

(58) Field of Classification Search
USPC ..... 148/330
See application file for complete search history.

(56) References Cited

U.S. PATENT DOCUMENTS

2001/0039983 A1* 11/2001 Inoue ..... C21D 8/0426 148/579
2019/0185952 A1* 6/2019 Mao ..... C22C 38/18

FOREIGN PATENT DOCUMENTS

| | | |
|---|---|---|
| CN | 102345076 | 2/2012 |
| CN | 102965573 | 3/2013 |
| CN | 103658178 | 3/2014 |
| CN | 104532156 | 4/2015 |
| CN | 106119692 | 11/2016 |
| JP | 2008214650 | 9/2008 |

OTHER PUBLICATIONS

NPL: On-line translation of CN-102031456, A Apr. 2011 (Year: 2011).*
"International Search Report (Form PCT/ISA/210)", dated Nov. 7, 2017, with English translation thereof, pp. 1-4.

* cited by examiner

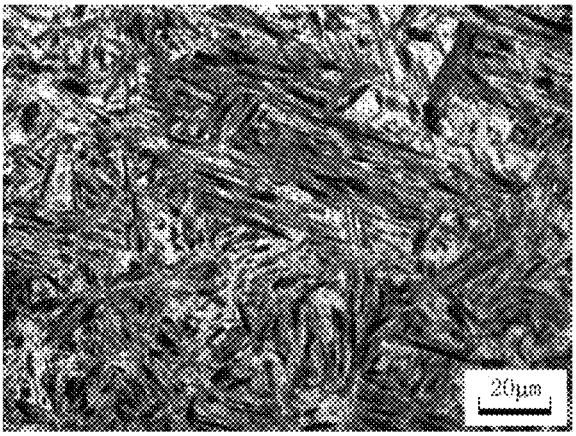
20μm

1500 MPA GRADE PRESS HARDENING STEEL BY MEDIUM THIN SLAB CASTING AND DIRECT ROLLING AND METHOD FOR PRODUCING THE SAME

CROSS-REFERENCE TO RELATED APPLICATION

This is a 371 application of the International PCT application serial no. PCT/CN2017/095493, filed on Aug. 1, 2017, which claims the priority benefits of China Application No. 201610713635.5, filed on Aug. 24, 2016. The entirety of each of the above-mentioned patent applications is hereby incorporated by reference herein and made a part of this specification.

BACKGROUND OF THE INVENTION

1. Technical Field

The present invention relates to a steel for automobile parts and a producing method thereof, and in particular, to a press hardening steel by medium and thin slab casting and direct rolling and having a tensile strength of 1500 MPa or more and a production method thereof. The producing method is adapted for a product having a thickness range of 2 to 10 mm.

2. Background

With the development of automobile industry and the gradual development of automobile design and manufacturing in a direction of energy conservation, environmental protection and safety in the automobile industry, lightweight automobile designs have become the tendency of automobile design for a long time now and in future.

The researches show that there was a linear relationship between an overall weight and energy consumption of an automobile. According to statistics, fuel efficiency can be increased by 6% to 8% for every 10% reduction in automobile weight. One of the most important ways to reduce the weight of an automobile is to use a high-strength and ultra-high-strength steel, so that a curb weight of the automobile can be greatly reduced without compromising a collision safety and the comfort. However, as the strength continues to increase, formability of a steel sheet will become worse, especially for an ultra-high-strength steel of above 1500 MPa. During the forming process, there will be problems such as cracking, springback and low dimensional accuracy of parts. Furthermore, higher requirements are imposed on stamping equipment, that is, a large-tonnage stamping machine and a high-wearing die are required, and a life cycle of the die is greatly affected. At present, there is no cold forming stamping equipment and die capable of forming 1500 MPa or above in the country.

At present, 1500 MPa-grade press hardening steels produced by the existing technology in the country and abroad are cold-rolled annealed or pre-coated after being cold-rolled annealed. The production process includes: metal desulphurization molten iron→converter steelmaking→external refining→continuous casting→slab heating→hot rolling→acid pickling+cold rolling→continuous annealing→(pre-coating)→finishing packaging→blanking→heating→die stamping and quenching. There is a shortage of long production process and high cost. For some anti-collision or load-bearing parts, multiple parts combined with members are used to improve the anti-collision and load-carrying capacity, which leads to greatly increased raw material cost and processing cost.

With the development of iron and steel industry, a medium thin slab casting and direct rolling process has been greatly developed. The medium thin slab continuous casting and direct rolling process can directly produce steel sheet and strip with a nominal thickness of more than 2.0-10 mm. Some thin-specification parts only adopting cold-rolled high-strength steels or members composed of multiple parts for strengthening have been gradually replaced by directly rolling ultra-high-strength steel sheet using a slab casting and direct rolling process. For example, Chinese Patent Publication No. CN 102965573A has developed a high-strength steel for engineering structures with a yield strength ($R_{eL}$) of 700 MPa or more and a tensile strength ($R_m$) of 750 MPa or more. The steel sheet has the chemical composition of: C: 0.15-0.25%, Si≤0.10%, Mn: 1.00-1.80%, P≤0.020%, S≤0.010%, Ti: 0.09-0.20%, Als: 0.02-0.08%, N≤0.008%, and a balance of Fe and inevitable impurities, in terms of % by mass. The invention steel sheet can be produced by a production method including: smelting and continuous casting into a slab, soaking, and controlling the soaking temperature to be 1200-1300° C. and a soaking time to be 20-60 min; hot rolling, and controlling a rolling temperature to be not lower than 1200° C. and a finishing rolling temperature to be 870-930° C.; performing laminar cooling, cooling to a coiling temperature at a cooling speed of not lower than 20° C./s; and performing coiling, and controlling a coiling temperature to be 580-650° C. Chinese patent Publication No. CN 103658178A invents a short-flow method for producing a high-strength thin strip steel. The invented strip steel has a yield strength ($R_{eL}$)≥550 MPa and a tensile strength ($R_m$)≥600 MPa. The strip steel includes following chemical components by mass percent: C: 0.02-0.15%, Si: 0.20-0.6%, Mn: 0.2-1.50%, P: 0.02-0.3%, S≤0.006%, Cr: 0.40-0.8%, Ni: 0.08-0.40%, Cu: 0.3-0.80%, Nb: 0.010-0.025%, Ti: 0.01-0.03%, Al: 0.01-0.06%, Re: 0.02-0.25%, and the balance of Fe and inevitable impurities. After smelting, a casting strip with a thickness of 1.0-2.0 mm is cast at a casting speed of 60-150 m/min; rolling is performed, and the finish rolling temperature is controlled to be 850-1000° C.; atomization cooling is adopted at a cooling speed of 50-100° C./s, coiling is performed, and a coiling temperature is controlled to be 520-660° C. The tensile strength of the above two documents is very low, which cannot meet a demand of a high-end automobile body for ultra-high strength of 1500 MPa or more.

SUMMARY OF THE INVENTION

The present invention is directed to a press hardening steel having a tensile strength of 1500 MPa or more and a production method thereof, which is short in process, good in surface quality and high in thickness precision, can meet quality requirements for cold-rolled products and can also smoothly complete complex deformation with no resilience present after deformation and high dimensional accuracy of parts, so as to overcome the shortcomings in the prior art that the manufacturing cost is high and the demands of a user for ultra-high-strength parts cannot be met due to long process and low strength level of a steel plate rolled directly from a medium thin slab.

Measures for achieving the foregoing objectives are taken as follows.

A press hardening steel is rolled directly from a medium thin slab and has a tensile strength of 1500 MPa or more. The press hardening steel sheet has the chemical composition of: C: 0.21%-0.25%, Si: 0.26%-0.30%, Mn: 1.0%-1.3%, P≤0.01%, S≤0.005%, Als: 0.015%-0.060%, Cr: 0.25%-0.30%, Ti: 0.026%-0.030% or Nb: 0.026%-0.030% or V: 0.026%-0.030% or a mixture of any two or more of the above in any proportion, B: 0.003%-0.004%, Mo: 0.17-0.19% and N≤0.005%, and a balance of Fe and inevitable impurities.

A method for producing the press hardening steel by the medium thin slab and having the tensile strength of 1500 MPa or more is characterized by including following steps.

1) Hot melt desulphurizing molten iron, and controlling S≤0.002%, an exposed surface of the molten iron after slagging off being not lower than 96%.

2) Performing conventional electric furnace or converter smelting, and conventional refining;

3) Performing continuous casting, and controlling a degree of superheat of tundish molten steel to be 15-30° C., a thickness of a slab to be 61-150 mm, and a casting speed to be 2.8-5.5 m/min.

4) Performing descaling treatment before the slab enters a soaking furnace, and controlling a pressure of descaling water to be 300-400 bar.

5) Performing conventional soaking on the slab, and controlling in the soaking furnace in a weak oxidizing atmosphere, i.e. a residual oxygen content in the furnace being 0.5-5.0%.

6) Heating the slab, and controlling a temperature of the slab entering the furnace to be 780-1000° C. and a temperature of the slab leaving the furnace to be 1135-1165° C.

7) Performing high-pressure water descaling before entering a rolling mill, and controlling the pressure of the descaling water to be 280-420 bar;

8) Hot rolling, controlling a first pass reduction rate to be 40-50%, a second pass reduction rate to be 40-50% and a final pass reduction rate to be 10-16%, controlling a rolling speed to be 3-8 m/s, performing medium-pressure water descaling between a first pass and a second pass under the pressure of the descaling water of 200-280 bar, and controlling a finishing rolling temperature to be 830-870° C.;

9) Cooling to a coiling temperature in a manner of laminar cooling, water curtain cooling or intensified cooling.

10) Performing coiling, and controlling the coiling temperature to be 635-665° C.

11) Performing austenitizing after uncoiling and blanking, controlling an austenitizing temperature to be 930-980° C., and holding the temperature for 6-15 min;

12) Die punching and deforming, and keeping a pressure for 6-9 s in a die.

13) Performing quenching, controlling a quenching cooling speed to be 50-100° C./s, and then naturally cooling to a room temperature.

It is characterized in that a rolling process of the medium thin slab is carried out in rolling mill arrangement forms such as a 6F production line or a 1R+6F production line, or a 2R+6F production line, or a 7F production line, or a 3R+4F production line, or 2R+5F production line, or a 1R+5F production line.

Mechanism of each element and main process in the present invention.

C: Carbon is a strong solution strengthening element, which plays a decisive role in the acquisition of ultra-high strength. The carbon content has a great influence on the microstructures and properties of the final product, but the content is too high, and it is easy to form a large amount of pearlite or bainite or martensite in the cooling process after finish rolling. The higher the content, the higher the strength, which results in decrease in plasticity and difficulty in blanking before forming. Therefore, under the premise of ensuring heat treatment strengthening, the carbon content should not be too high. Therefore, the content is limited to a range of 0.21% to 0.25%.

Si: Silicon has a strong solution strengthening effect, which can improve the strength of steel. Furthermore, silicon can improve a hardenability of steel and reduce a volume change of austenite transforms into martensite, thus effectively controlling the production of quenching cracks. During low temperature tempering, a diffusion of carbon can be hindered, and the decomposition of martensite and the aggregation and growth of carbide are delayed, so that a hardness of steel decreases slowly during tempering, which significantly improves the tempering stability and strength of steel. Therefore, the content is limited to a range of 0.26% to 0.30%.

Mn: Manganese acts as a solution strengthening agent, and furthermore, it can remove FeO in steel and significantly improve the quality of steel. It can also form MnS with a high melting point with sulphide. In thermal processing, MnS has sufficient plasticity to prevent steel from hot shortness, reduce the harmful effects of sulphur, and improve a hot workability of steel. Manganese can reduce a phase change driving force, make a "C" curve shift to the right, improve the hardenability of steel, enlarge a y phase region, and reduce the $M_s$ point of steel, so it can be ensured that martensite is obtained at a suitable cooling speed. Therefore, the content is limited to a range of 1.0% to 1.3%.

Cr: Chromium can reduce the phase transformation driving force and also reduce the nucleation growth of carbides during phase transformation, so the hardenability of steel is improved. In addition, chromium can improve the tempering stability of steel. Therefore, the content is limited to a range of 0.25% to 0.30%.

B: Boron is an element that strongly enhances hardenability. The addition of trace amounts of boron to steel can significantly improve the hardenability of the steel. However, the content is lower than 0.003%, or higher than 0.004%, and the effect on improving hardenability is not obvious. Therefore, in order to consider the actual production and hardenability effects, the content is limited to a range of 0.003% to 0.004%.

Als: It deoxidizes in steel, it should be ensured that there is a certain amount of acid-soluble aluminium in the steel, otherwise it will not exert its effect, but too much aluminium will cause aluminium-based inclusions in the steel, which is not conducive to steel smelting and casting. Furthermore, the addition of an appropriate amount of aluminium in steel can eliminate the adverse effects of nitrogen and oxygen atoms on the properties of the steel.

Therefore, the content is limited to a range of 0.015% to 0.060%.

P: Phosphorus is a harmful element in steel, which is liable to cause segregation in a centre of a slab. In the subsequent hot continuous rolling heating process, it tends to be segregated to a grain boundary, so that a brittleness of steel is significantly increased. Furthermore, based on cost considerations and without affecting the properties of the steel, the content is controlled to be 0.01% or less.

S: Sulphur is a very harmful element. Sulphur in steel is often present in the form of sulphides of manganese. This sulphide inclusion can deteriorate a toughness of the steel and cause anisotropy of properties. Therefore, it is necessary to control the sulphur content in the steel as low as possible. The sulphur content in the steel is controlled to be 0.005% or less based on consideration of manufacturing cost.

N: Nitrogen can be combined with titanium to form titanium nitride in titanium-added steel. This second phase precipitated at high temperature is beneficial for strengthening a matrix and improving a weldability of a steel plate. However, the nitrogen content is higher than 0.005%, and a solubility product of nitrogen and titanium is higher. At high temperature, a coarse titanium nitride is formed in the steel, which seriously damages the plasticity and toughness of the steel. In addition, the higher nitrogen content will increase the amount of micro-alloying elements required to stabilize the nitrogen element, thereby increasing the cost. Therefore, the content is controlled to be less than 0.005%.

Ti: Titanium is a strong C and N compound forming element. The purpose of adding Ti to steel is to fix the N element in the steel, but the excess Ti will combine with C to reduce the hardness and strength of martensite after quenching of the test steel. In addition, the addition of titanium contributes to the hardenability of steel. Therefore, the content is limited to a range of 0.026 to 0.030%.

Nb, V: Niobium and vanadium are also strong C and N compound forming elements, which can refine austenite grains. A small amount of niobium or vanadium can be added into steel to form a certain amount of niobium carbon and nitride, so that growth of the austenite grain is hindered, and therefore, a size of a martensite lath after quenching is small, and the strength of the steel is greatly improved. Therefore, the content is controlled between 0.026% and 0.030%.

Mo: Molybdenum can significantly improve the hardenability of steel, and a stacking fault energy of molybdenum is high. The addition of the molybdenum into steel can improve the low temperature plasticity and toughness of the steel. Therefore, the content is controlled between 0.17% and 0.19%.

The reason why the present invention adopts three times of descaling in the whole production process is that mill scale on a surface of a strip steel can be removed as much as possible by controlling the descaling pass and the appropriate descaling water pressure, thereby ensuring that the strip steel has a good surface quality. In addition, microstructure uniformity and property stability of the strip steel can be realized by controlling the first pass reduction rate, the second pass reduction rate and the final pass reduction rate.

Compared with the prior art, the present invention has short process, good surface quality, and high thickness precision; quality requirements for cold-rolled products may be met, and complex deformation may be smoothly completed; moreover, no resilience is present after deformation, and dimensional accuracy of parts is high.

BRIEF DESCRIPTION OF THE DRAWINGS

FIG. 1 is a microstructure of a product according to the present invention.

DESCRIPTION OF THE EMBODIMENTS

The present invention is described in detail below.

Table 1 is a list of chemical component values of various embodiments and comparative examples of the present invention.

Table 2 is a list of main process parameter of various embodiments and comparative examples of the present invention.

Table 3 is a list of property detection cases of various embodiments and comparative examples of the present invention.

In various embodiments of the present invention, production is performed according to following process:

1) Hot melt desulphurize, and control S≤0.002%, an exposed surface of the molten iron after slagging off being not lower than 96%.

2) Perform conventional electric furnace or converter smelting, and conventional refining.

3) Perform continuous casting, and control a degree of superheat of tundish molten steel to be 15-30° C., a thickness of a slab to be 61-150 mm, and the casting speed to be 2.8-5.5 m/min.

4) Perform descaling treatment before the slab enters a soaking furnace, and control a pressure of descaling water to be 300-400 bar.

5) Perform conventional soaking on the slab, and control inside the soaking furnace in a weak oxidizing atmosphere, i.e. a residual oxygen content in the furnace being 0.5-5.0%.

6) Heat the slab, and control a temperature of the slab entering the furnace to be 780-1000° C. and a temperature of the slab leaving the furnace to be 1135-1165° C.

7) Perform high-pressure water descaling before entering a rolling mill, and control the pressure of the descaling water to be 280-420 bar.

8) Perform hot rolling, control a first pass reduction rate to be 40-50%, a second pass reduction rate to be 40-50% and a final pass reduction rate to be 10-16%, control a rolling speed to be 3-8 m/s, perform medium-pressure water descaling between a first pass and a second pass under the pressure of the descaling water of 200-280 bar, and control a finishing rolling temperature to be 830-870° C.

9) Cool to a coiling temperature in a manner of laminar cooling, water curtain cooling or intensified cooling.

10) Perform coiling, and control the coiling temperature to be 635-665° C.

11) Perform austenitizing after uncoiling and blanking, control an austenitizing temperature to be 930-980° C., and hold for 6-15 min.

12) Perform die stamping forming, and keep a pressure for 6-9 s in a die.

13) Perform quenching, control a quenching cooling speed to be 50-100° C./s, and then naturally cool to a room temperature.

TABLE 1

Chemical component (wt. %) of various embodiments and comparative examples of the present invention

| Embodiment | C | Si | Mn | P | S | Als | Cr | Ti | Nb | V | Mo | B | N |
|---|---|---|---|---|---|---|---|---|---|---|---|---|---|
| 1 | 0.24 | 0.27 | 1.02 | 0.005 | 0.005 | 0.024 | 0.26 | 0.030 | — | — | — | 0.0032 | 0.003 |
| 2 | 0.225 | 0.30 | 1.10 | 0.008 | 0.002 | 0.036 | 0.30 | 0.026 | 0.027 | — | — | 0.0036 | 0.002 |
| 3 | 0.21 | 0.29 | 1.30 | 0.004 | 0.003 | 0.022 | 0.295 | — | 0.030 | — | — | 0.0040 | 0.004 |
| 4 | 0.25 | 0.26 | 1.00 | 0.004 | 0.005 | 0.060 | 0.25 | — | 0.026 | 0.026 | — | 0.0035 | 0.005 |
| 5 | 0.23 | 0.28 | 1.20 | 0.010 | 0.001 | 0.015 | 0.27 | 0.028 | — | — | 0.19 | 0.0030 | 0.004 |
| 6 | 0.22 | 0.285 | 1.22 | 0.003 | 0.003 | 0.055 | 0.28 | — | — | 0.030 | — | 0.0034 | 0.002 |
| 7 | 0.246 | 0.265 | 1.26 | 0.006 | 0.002 | 0.045 | 0.29 | 0.024 | — | 0.025 | 0.17 | 0.0038 | 0.003 |
| Comparative example 1 | 0.20 | 0.08 | 1.50 | 0.010 | 0.006 | 0.040 | — | 0.10 | — | — | — | — | 0.006 |
| Comparative example 2 | 0.13 | 0.45 | 1.3 | 0.025 | 0.005 | 0.04 | 0.50 | 0.02 | 0.02 | — | — | — | 0.004 |

TABLE 2

List of main process parameter values of various embodiments and comparative examples of the present invention

| Embodiment | Temperature of slab into furnace ° C. | Tapping temperature ° C. | Finish rolling temperature ° C. | Coiling temperature ° C. | Austenitizing temperature ° C. | Temperature holding time min | Quenching cooling speed ° C./s | Pressure keeping time in dies |
|---|---|---|---|---|---|---|---|---|
| 1 | 833-846 | 1149-1164 | 858-870 | 635-646 | 970 | 6 | 100 | 8 |
| 2 | 791-802 | 1153-1165 | 830-842 | 637-648 | 980 | 6 | 97 | 6 |
| 3 | 986-1000 | 1135-1148 | 852-864 | 649-660 | 955 | 8 | 85 | 9 |
| 4 | 966-975 | 1137-1149 | 835-847 | 638-652 | 975 | 9 | 90 | 7 |
| 5 | 780-792 | 1145-1157 | 845-857 | 636-649 | 935 | 12 | 86 | 6 |
| 6 | 926-940 | 1143-1155 | 856-868 | 641-654 | 930 | 15 | 62 | 8 |
| 7 | 870-885 | 1147-1160 | 840-851 | 652-665 | 945 | 14 | 50 | 9 |
| Comparative example 1 | — | 1232-1245 | 890-905 | 602-617 | — | — | — | — |
| Comparative example 2 | — | — | 895-915 | 647-658 | — | — | — | — |

TABLE 3

List of mechanical property cases of various embodiments and comparative examples of the present invention

| Component | Thickness mm | Yield strength $R_{p0.2}$ MPa | Tensile strength $R_m$ MPa | Elongation $A_{80\ mm}$ % |
|---|---|---|---|---|
| 1 | 5.0 | 1090 | 1530 | 6.3 |
| 2 | 7.0 | 1070 | 1550 | 7.2 |
| 3 | 2.1 | 1120 | 1625 | 6.2 |
| 4 | 3.5 | 1050 | 1520 | 7.8 |
| 5 | 4.5 | 1080 | 1560 | 7.4 |
| 6 | 10.0 | 1060 | 1540 | 6.6 |
| 7 | 9.0 | 1065 | 1535 | 6.7 |
| Comparative example 1 | 3.0 | 715 | 750 | 21 |
| Comparative example 2 | 5.5 | 565 | 655 | 22 |

As can be seen from Table 3, a short process for directly rolling from a thin slab makes the strength of the steel of the invention up to 1500 MPa, which makes the strength thereof much higher than that of existing short-process products and is of great significance for promoting the development of lightweight automobiles.

The present specific implementation is merely exemplary and does not limit the implementation of the technical solutions of the present invention.

What is claimed is:

1. A method for producing a press hardening steel, wherein the press hardening steel is produced by directly rolling and casting a slab and has a tensile strength of 1500 MPa or more, and the press hardening steel comprises following components by weight percent: C: 0.21%-0.25%, Si: 0.26%-0.30%, Mn: 1.0%-1.3%, P≤0.01%, S≤0.005%, Als: 0.015%-0.060%, Cr: 0.25%-0.30%, Ti: 0.026%-0.030% or Nb: 0.026%-0.030% or V: 0.026%-0.030% or a mixture of any two or more of the above in any proportion, B: 0.003%-0.004%, Mo: 0.17-0.19%, N≤0.005%, and a balance of Fe and inevitable impurities, the method comprising following steps:

step 1: desulphurizing molten iron, and controlling S to be smaller or equal to 0.002%, an exposed surface of the molten iron after slagging off being not lower than 96%;

step 2: performing conventional electric furnace or converter smelting, and conventional refining;

step 3: performing continuous casting, and controlling a degree of superheat of tundish molten steel to be 15° C. to 30° C., a thickness of the slab to be 61 mm to 150 mm, and a casting speed to be 2.8 m/min to 5.5 m/min;

step 4: performing descaling treatment before the slab enters a soaking furnace, and controlling a pressure of descaling water to be 300 bar to 400 bar;

step 5: performing conventional soaking on the slab, and controlling inside of the soaking furnace in a weak oxidizing atmosphere even if a residual oxygen content in the furnace is 0.5% to 5.0%;

step 6: heating the slab, and controlling a temperature of the slab entering the furnace to be 780° C. to 1000° C. and a temperature of the slab leaving the furnace to be 1135° C. to 1149° C.;

step 7: performing high-pressure water descaling before entering a rolling mill, and controlling the pressure of the descaling water to be 280 bar to 420 bar;

step 8: hot rolling, controlling a first pass reduction rate to be 40-50%, a second pass reduction rate to be 40% to 50% and a final pass reduction rate to be 10-16%, controlling a rolling speed to be 3 m/s to 8 m/s, performing medium-pressure water descaling between a first pass and a second pass under the pressure of the descaling water of 200 bar to 280 bar, and controlling a finishing rolling temperature to be 830° C. to 870° C.;

step 9: cooling to a coiling temperature in a manner of laminar cooling, water curtain cooling or intensified cooling;

step 10: performing coiling, and controlling the coiling temperature to be 635° C. to 665° C.;

step 11: performing austenitizing after uncoiling and blanking, controlling an austenitizing temperature to be 930° C. to 980° C., and holding for 12 minutes to 15 minutes;

step 12: die punching and deforming, and keeping a pressure for 6 seconds to 9 seconds in a die; and step 13: performing quenching, controlling a quenching cooling speed to be 50° C./s to 100° C./s, and then naturally cooling to a room temperature.

2. The method for producing the press hardening steel according to claim 1, wherein the rolling process of the slab is carried out in rolling mill arrangement forms such as a 6 finishing mills production line or a 1 roughing mill+6 finishing mills production line, or a 2 roughing mills+6 finishing mills production line, or a 7 finishing mills production line, or a 3 roughing mills+4 finishing mills production line, or 2 roughing mills+5 finishing mills production line, or a 1 roughing mill+5 finishing mills production line.

* * * * *